United States Patent [19]

Lippiello et al.

[11] Patent Number: 5,031,646

[45] Date of Patent: Jul. 16, 1991

[54] CIGARETTE

[75] Inventors: Patrick M. Lippiello; Robert L. Suber, Sr., both of Clemmons; Jerry W. Redding, Lexington; Thomas A. Perfetti, Winston-Salem, all of N.C.

[73] Assignee: R. J. Reynolds Tobacco Company, Winston-Salem, N.C.

[21] Appl. No.: 464,806

[22] Filed: Jan. 16, 1990

[51] Int. Cl.[5] ..... A24B 15/10; A24B 15/30

[52] U.S. Cl. ..... 131/352; 131/335; 131/276

[58] Field of Search ..... 131/352, 335, 276

[56] References Cited

U.S. PATENT DOCUMENTS 2,766,145 10/1956 Jones .
2,914,072 11/1959 Tyrer et al. .
3,136,319 6/1964 Jarboe .
3,924,642 12/1975 Eicher et al. .
4,125,118 11/1978 Rudner .
4,274,427 6/1981 Lendvay .
4,714,082 12/1987 Banerjee et al. .
4,830,028 5/1989 Lawson et al. .
4,836,224 6/1989 Lawson et al. .

FOREIGN PATENT DOCUMENTS 8387-82 7/1983 Japan .

OTHER PUBLICATIONS

*Tobacco Flavoring for Smoking Products*, Leffingwell et al., pp. 11–15 (1972).

*Levulinic Acid as a Basic Chemical Raw Material*, Leonard, Industrial and Engineering Chemistry; vol. 48, pp. 1331–1341 (1956).

*Tobacco and Tobacco Smoke*, Wynder et al., p. 428 (1962).

*Determination of Nonvolatile Organic and Fatty Acids in Flue-Cured Tobacco by Gas-Liquid Chromatography*, Court et al., Journal of Chromatographic Science; vol. 16, pp. 314–316 (1978).

*The Distribution of Cigarette Smoke Components between Mainstream and Sidestream Smoke*, Sakuma et al., Beitr. Tabak., vol. 12, pp. 63–71 (1983).

*Primary Examiner*—V. Millin

[57] ABSTRACT

Cigarettes having high nicotine content tobacco cut filler are rendered smooth smoking and palatable by incorporating an organic acid salt additive therein. For example, a cigarette having a cut filler with a blend nicotine content of greater than 2 percent has a sodium levulinate additive combined with the tobacco cut filler of the cigarette. Smooth smoking cigarettes yielding good tobacco taste and minimal off-taste are provided.

34 Claims, 1 Drawing Sheet

CIGARETTE

BACKGROUND OF THE INVENTION

The present invention relates to cigarettes and other such types of smoking articles, and in particular to those smoking articles having at least one salt of an organic acid incorporated therein.

Cigarettes are popular smoking articles which have a substantially cylindrical rod shaped structure and include a charge of tobacco (i.e., in cut filler form) surrounded by a wrapper, such as paper, thereby forming a tobacco rod. Currently, popular cigarettes include blends of tobacco materials, the majority of the blends having nicotine contents in the range from about 1.2 percent to about 2.25 percent, more frequently from about 1.4 percent to about 2 percent, and most frequently from about 1.6 percent to about 1.8 percent, based on the dry weight of the tobacco materials. It has become desirable to manufacture a cigarette having a cylindrical filter element aligned in an end-to-end relationship with the tobacco rod. Typically, a filter element is manufactured from fibrous materials (e.g., cellulose acetate tow) and is circumscribed by plug wrap, attached to the tobacco rod using a circumscribing tipping material.

Popular cigarettes classified as "full flavor" cigarettes deliver a desirable tobacco taste, flavor and satisfaction to the smoker. Typically, the "full flavor" cigarettes yield about 14 mg or more of FTC "tar" per cigarette. A second classification of popular cigarettes is the "full flavor low tar" classification. Typically, the "full flavor low tar" cigarettes yield from about 8 to about 14 mg of FTC "tar" per cigarette, as well as lower levels of FTC nicotine as compared to "full flavor" cigarettes. A third classification of popular cigarettes is the "ultra low tar" classification. Such "ultra low tar" cigarettes yield still lower levels of FTC "tar" and nicotine. Typically, the "ultra low tar" cigarettes yield less than about 7 mg of FTC "tar" per cigarette. The "full flavor low tar" and "ultra low tar" cigarettes conventionally are air diluted (e.g., provided with mechanical or laser perforations in the periphery of the mouthend region thereof), or have filter elements highly efficient for the removal of "tar" and nicotine from the mainstream smoke.

In general, the perceived taste or strength of the cigarettes classified as having lower levels of "tar" and nicotine are progressively less than that of the cigarettes which are classified as approaching the characteristics of the "full flavor" cigarettes. It has been proposed to add numerous flavorants to the cut filler of lower "tar" cigarettes to enhance the taste, strength and satisfaction of such cigarettes. However, such addition generally yields mainstream smoke which may be perceived as harsh or irritating to the mouth, nose and throat of the smoker.

Additionally, it is possible to employ tobaccos having a naturally high nicotine content as cut filler to enhance the tobacco taste, strength and satisfaction of such cigarettes. However, cigarettes having high nicotine contents (e.g., which include tobacco blends having natural nicotine contents above about 2.25 weight percent) generally have the propensity to yield unpalatable mainstream smoke which may be perceived as harsh or irritating to the mouth, nose and throat of the smoker.

It would be desirable to provide a cigarette such as an "ultra low tar" cigarette which is capable of delivering a good tobacco taste, strength and smoking satisfaction characteristic of a "full flavor low tar" cigarette while being perceived as palatable but not as overly harsh or irritating. In addition, it would be desirable to provide a cigarette, such as a "full flavor low tar" cigarette, which is capable of delivering a good tobacco taste, strength and smoking satisfaction characteristic of a "full flavor" cigarette while being perceived as palatable but not as overly harsh or irritating. Furthermore, it would be desirable to improve the smoking character of cigarettes which employ tobaccos or other tobacco materials having a wide range of nicotine contents.

SUMMARY OF THE INVENTION

The present invention relates to a smoking article which delivers good tobacco taste while being capable of delivering relatively low amounts of FTC "tar." Preferred articles of this invention are cigarettes which deliver taste, strength and smoking satisfaction characteristic of "full flavor" cigarettes, and relatively low levels of FTC "tar" characteristic of "full flavor low tar" cigarettes. Also preferred are cigarettes which deliver taste, strength and smoking satisfaction characteristic of "full flavor low tar" cigarettes, and relatively low levels of FTC "tar" characteristic of "ultra low tar" cigarettes. In addition, the preferred cigarettes are extremely palatable and provide the perception of having a smooth smoking character (i.e., not providing a perceived harsh or irritating character) relative to a comparable cigarette yielding similar levels of FTC "tar." Of particular interest are cigarettes having (i) relatively low FTC "tar" to FTC nicotine ratios, (ii) relatively low FTC carbon monoxide to FTC nicotine ratios, (iii) good tobacco flavor, strength and satisfaction, and (iv) a smooth, palatable smoking character without being overly mild tasting.

A cigarette of the present invention includes a smokable material contained in a circumscribing outer wrapping material. The cigarette includes (i) smokable (e.g., tobacco) material, and (ii) an additive in the form of at least one inorganic salt of an organic acid in contact with the smokable material. For example, a highly preferred cigarette of the present invention includes (i) a smokable material having a nicotine content above about 2 percent, based on the dry weight of the smokable material, and (ii) an inorganic salt of levulinic acid in contact with at least a portion of the smokable material. The amount of the inorganic salt of levulinic acid which is added to the smokable material generally is such that the smokable material includes greater than about 0.01 percent, more preferably greater than about 0.75 percent, of levulinate moiety (i.e., anionic moiety), based on the dry weight of the smokable material. Preferred cations useful for providing the inorganic salt of levulinic acid include the alkali metal and alkali earth metal ions.

As used herein, the term "dry weight" in referring to the smokable material of the smoking article is meant the mass of the smokable material after being dried to constant weight at 214° F. (101° C.) for 3 hours in a force-draft oven. See, Moseley et al, *Ind. Eng. Chem.*, Vol. 43, p. 2342 (1951).

As used herein, the term "nicotine content" in referring to the smokable material is meant the mass alkaloid nicotine as analyzed and quantitated by spectroscopic techniques divided by the dry weight of the smokable material analyzed. See, Harvey et al, *Tob. Sci.*, Vol. XXV, p. 131 (1981).

The smokable material from which cigarettes of the present invention are manufactured conveniently can be a cut filler material composed of one or more tobacco materials having a naturally high nicotine content. Such naturally high nicotine content tobacco materials can be employed alone or as blends with (i) one or more tobacco materials having low nicotine contents, and/or (ii) one or more other smokable materials. As such, preferred cigarettes of the present invention include those cigarettes wherein the smokable material thereof exhibits a total nicotine content, or blend nicotine content, above about 2 percent.

The presence of an inorganic salt of levulinic acid within a cigarette having a relatively high nicotine content provides improved tobacco taste, strength and smoking satisfaction as well as improved or maintained flavor characteristics to mainstream smoke of that cigarette during smoking. Preferred cigarettes of this invention do not exhibit undesirable off-tastes during smoking. The inorganic salt of levulinic acid also has a propensity not to migrate from the smokable material with which the salt is contacted.

DETAILED DESCRIPTION OF THE PREFERRED EMBODIMENTS

Figure 1:
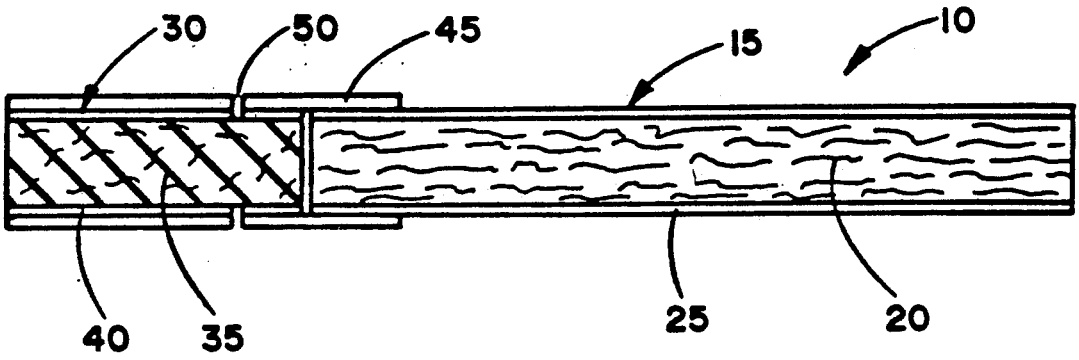
FIG. 1 is a longitudinal sectional view of a cigarette of the present invention.

One embodiment of the present invention is shown in FIG. 1, and has the form of a cigarette 10. The cigarette includes a generally cylindrical rod 15 of smokable material 20, such as tobacco cut filler, contained in circumscribing outer wrapping material 25. The rod 15 is hereinafter referred to as a "tobacco rod." The ends of the tobacco rod are open to expose the smokable material. The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes filter material 35 which is overwrapped along the longitudinally extending surface thereof with circumscribing plug wrap material 40.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the plug wrap 40 and the outer surface of the wrapping material 25 of the tobacco rod, using a suitable adhesive. If desired, a ventilated or air diluted cigarette is provided with an air dilution means such as a series of perforations 50 each of which extend through the tipping material and plug wrap.

Typically, the tobacco rod has a length which ranges from about 50 mm to about 85 mm, a circumference of about 17 mm to about 27 mm; and the wrapping material thereof is a conventional cigarette wrapping paper. Suitable cigarette wrapping papers are available as Reference Nos. 719, 856, P-2540-49, P-2540-10A, P-2540-10B, P-2123-101, P-2123-102, P-2123-104, P-2123-106, P-2123-107, P-2123-108, P-2123-109, P-2123-111, P-2123-112 and P-2123-114 from Kimberly-Clark Corp., or as Ecusta Experimental Nos. TOD 04620, TOD 04621, TOD 04706, TOD 04982 and TOD 05024 from Ecusta Corp. The wrapping papers can be electrostatically perforated. If desired a dual wrapper system can be employed. The tobacco rods and the resulting cigarettes can be manufactured in any known configuration using known cigarette making techniques and equipment.

Typically, the filter element has a length which ranges from about 20 mm to about 35 mm and a circumference of about 17 mm to about 27 mm. The filter material can be any suitable material such as cellulose acetate, polypropylene, tobacco paper material, or the like. Filter materials having compositions or characteristics so as to exhibit low nicotine filtration efficiencies can be employed. The plug wrap typically is a conventional paper plug wrap, and can be either air permeable or essentially air impermeable. However, if desired, a nonwrapped cellulose acetate filter element can be employed. The various filter elements suitable for use in this invention can be manufactured using known cigarette filter making techniques and equipment.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents, thereby providing a means for providing air dilution to the cigarette. The total surface area of the perforations and the positioning of the perforations along the periphery of the cigarette can be varied in order to control the performance characteristics of the cigarette.

As used herein, the term "air dilution" is the ratio (generally expressed as a percentage) of the volume of air drawn through the air dilution means to the total volume of air and aerosol drawn through the cigarette and exiting the extreme mouthend portion of the cigarette. For air diluted or ventilated cigarettes of this invention, the amount of air dilution can vary. Preferably, the amount of air dilution for a cigarette is greater than about 20 percent, more preferably greater than about 30 percent. The upper limit of air dilution for a cigarette typically is less than about 80 percent, more frequently less than about 60 percent.

The smokable material employed in the manufacture of the tobacco rod can vary. For example, the tobacco material can be engineered in a processed form such as an extruded form (e.g., as a foamed extruded rod or extruded into a tubular shape), have the form of filler such as tobacco cut filler, or the like. Generally, the tobacco material of cigarettes has the form of cut filler. As used herein, the terms "filler" or "cut filler" are meant to include tobacco materials which have a form suitable for use in the manufacture of cigarette tobacco rods. As such, filler can include tobacco materials which are blended and are in a form ready for cigarette manufacture. The tobacco filler materials conveniently are employed in the form of strands or shreds as is common in conventional cigarette manufacture. For example, the tobacco cut filler material can be employed in the form of strands cut into widths ranging from about 1/10 inch to about 1/60 inch, preferably from about 1/25 inch to about 1/40 inch. Generally, such strands have lengths which range from about ¼ inch to about 3 inches.

Tobacco materials can be cased and top dressed as is conventionally performed during various stages of cigarette manufacture. For example, additives such as flavorants and humectants can be applied to the tobacco material as is commonly done when cigarettes are manufactured. Suitable additives include flavorants such as vanillin, cocoa, licorice, menthol, tobacco aroma oils, tobacco extracts, and the like. Such additives conveniently are applied to the smokable material as top dressing components, or otherwise blended with the smokable material.

The majority of the filler material present in the smokable rod preferably is a tobacco material. However, the tobacco material can be blended with another smokable material, such as those smokable materials described in U.S. patent application Ser. No. 276,161, filed Nov. 23, 1988 and U.S. patent application Ser. No. 414,833 filed Sept. 29, 1989. Examples of suitable tobacco materials include flue-cured, Burley, Maryland or Oriental tobaccos; processed tobacco materials such as expanded tobaccos, processed tobacco stems, reconstituted tobacco materials or reconstituted tobacco materials having varying levels of endogenous and exogenous nicotine; or blends thereof.

Tobacco material(s) having a naturally high nicotine content conveniently constitute at least a portion of the smokable filler material useful in manufacturing cigarettes of the present invention. Typically, such useful high nicotine content tobaccos or high nicotine content processed tobaccos have nicotine contents of above about 2.5 percent. The nicotine contents of high nicotine tobacco materials oftentimes are above about 3 percent, frequently above about 4 percent, and in certain circumstances above about 5 percent. Generally, the nicotine content of tobacco materials useful in this invention does not exceed about 10 percent.

The high nicotine content filler material can vary. For example, tobaccos designated by the U.S.D.A. as Type 35 (One Sucker), Type 36 (Green River) or Type 37 (Virginia Sun Cured) are common tobaccos having a naturally high nicotine content. A cultivar such as *Nicotiana rustica* often has a natural nicotine content in the range of about 6 percent to about 10 percent. Additionally, also useful are upper stalk leaves of commercial lines of flue-cured tobacco (designated by the U.S.D.A. as Types 11–14) and Burley tobacco (designated by the U.S.D.A. as Type 31). The natural nicotine content of many tobaccos can depend upon the agronomic conditions under which the tobaccos are grown as well as the particular genetic line of the tobacco.

Processed tobacco materials can be employed. Such processed tobaccos can be provided using tobacco reconstitution-type processes. For example, materials can be manufactured using extrusion, cast sheet, fourdrinier or paper making processes. Raw materials used in manufacturing processed tobaccos can include those high nicotine tobaccos described hereinbefore; or various types of tobacco extracts can be employed in the manufacturing steps of the processed tobaccos. Alternatively, processed tobaccos can be manufactured under conditions suitable to provide products having various nicotine levels. If desired, nicotine can be incorporated into the expansion solvents used to provide a volume expanded processed tobacco material having a high nicotine content. Typical expansion processes are described in U.S. Pat. No. Re. 30,693 to Fredrickson and U.S. Pat. No. Re. 3,524,452 to Moser et al. Also, processed tobacco materials include tobaccos or tobacco materials mixed, blended or otherwise treated with tobacco extracts, spray dried tobacco extracts or tobacco aroma oils. Methods for providing suitable tobacco extracts are set forth in U.S. Pat. No. 4,506,682 to Mueller and European Patent Application Nos. 326,370 and 338,831. As such, the processed tobacco materials have high nicotine contents upon completion of the processing steps involved in their preparation or manufacture, and prior to their use in the manufacture of cigarettes.

High nicotine tobacco(s) and/or high nicotine processed tobacco(s) can be employed as the tobacco material of the cigarette, as the components of cigarette blends or as portions of the components of cigarette blends. For example, the high nicotine tobaccos and/or high nicotine processed tobacco materials can be blended with other smokable materials having nicotine contents of less than about 2 percent. Typically, the so-called "American blends" having high nicotine contents (i.e., total blend nicotine contents above about 2 percent) are desirable for cigarette manufacture. Typical total nicotine contents of the tobacco material or blends of materials from which tobacco rods for cigarettes of this invention are manufactured are greater than about 2.25 percent, generally greater than 2.5 percent, often greater than about 3 percent, frequently greater than about 3.5 percent, and in certain circumstances greater than about 4 percent.

The inorganic salt of the organic acid can vary, but includes an inorganic salt of levulinic acid. The alkali metal and alkali earth metal salts of inorganic acids are particularly preferred. Examples of suitable salts are calcium levulinate, magnesium levulinate, sodium levulinate and potassium levulinate. Such salts can be provided using the techniques described by Cox et al in U.S. Pat. No. 2,033,909. Alternatively, such salts can be obtained from Pfaltz and Bauer, Inc., Waterbury, Conn. or K&K Laboratories, Div. of ICN Biochemicals, Inc., Cleveland, Ohio.

Other organic acids and/or inorganic salts of organic acids can be employed according to the present invention in addition to the inorganic salt of levulinic acid. For example, salts of malic, citric, oxalic, malonic, succinic, ascorbic, tartaric and fumaric acids can be contacted with the smokable material of cigarettes of the present invention. The calcium, magnesium, sodium and potassium salts of such acids are particularly preferred. As such acids commonly are flavoring agents for smokable materials, the acids themselves and/or the inorganic salts of such acids are added to the smokable material of cigarettes of the present invention in amounts which depend upon the flavor threshold of the particular acid and the specific flavor characteristics of the acid. For example, it may be desirable to employ certain organic acids and inorganic salts of such organic acids at low enough levels, in order that the cigarette does not exhibit taste or aroma characteristics which can be perceived as being chemical, metallic, bitter, pungent or soapy in nature, or as being dissonant to the general organoleptic characteristics associated with tobacco smoke.

The inorganic salt of the organic acid can be contacted with the smokable material in a variety of ways. For example, the inorganic salt of the organic acid can be applied to the smokable filler material or combined with some or all of the smokable filler material. If desired, the inorganic salts of organic acids can be incorporated into processed tobacco filler materials during the manufacture of such materials. For example, such additives can be mixed with tobacco extracts (e.g., tobacco essences or tobacco aroma oils), and the resulting tobacco extracts can be blended with, mixed with, or otherwise used to treat smokable materials.

Typically, the inorganic salt of the organic acid is incorporated in the cigarette by admixing that additive with at least a portion of the smokable material. The manner or process for applying the salt additive to the smokable material can vary depending upon whether the additive is applied diluted in liquid form, or upon the positioning of the additive with respect to the smokable material. For example, the additive can be applied using syringes or techniques such as spraying, casing, electrostatic deposition, impregnation, garniture injection, spray drying, inclusion and encapsulation techniques, and the like.

Suitable liquid carriers for the salt additives include water, ethanol, glycerol, propylene glycol, and the like, as well as combinations thereof.

One or more organic acids and/or salts provided from nicotine and an organic acid can be incorporated into the cigarette. The use of nicotine salts can provide for a cigarette having a relatively high nicotine content as well as provide the organic acid additive. The nicotine salts can be incorporated into cigarettes which include smokable materials having a wide range of nicotine contents. In addition, organic acids in acid form (e.g., levulinic acid) can be incorporated into the cigarette. See, U.S. Pat. No. 4,836,224 to Lawson et al, which is incorporated herein by reference.

Various amounts of the particular inorganic salts of the organic acid can be employed within the cigarettes of the present invention. The amount of salt additive incorporated within a cigarette can vary so as to provide a cigarette yielding acceptable tobacco taste, strength and satisfaction upon smoking. Generally, the amount of inorganic salt of the organic acid combined with the smokable material is such that the anionic moiety of the salt is greater than about 0.01 percent, frequently about 0.1 percent, preferably above about 0.5 percent, more preferably above about 0.75 percent, and most preferably above about 1 percent, based on the dry weight of the smokable filler material within the cigarette. Although the amount of inorganic salt of the organic acid which is combined with the smokable material is such that the anionic moiety of the salt can exceed about 1.5 percent; the amount of such additive typically is less than about 5 percent, and is more typically less than about 3 percent, based on the dry weight of the smokable filler material.

The cigarettes of this invention preferably provide a mainstream smoke exhibiting a pH which is essentially equal to or less than that of a similar cigarette absent of the organic acid salt additive incorporated therein. In certain circumstances, an amount of organic acid salt additive is incorporated into a cigarette in order to reduce the pH of the mainstream smoke during use thereof. Mainstream smoke is that smoke which is drawn through the cigarette and into the mouth of the smoker. For example, for a cigarette having smokable tobacco material contained in a circumscribing outer wrapping material, the mainstream smoke is the mainstream tobacco smoke which includes the combustion and/or pyrolysis products of tobacco material.

In referring to a reduction in the pH of mainstream smoke, it is meant a lowering of the average pH of the mainstream smoke per particular cigarette. Such reduction is provided by the addition of an effective amount of the additive. Typically, the reduction in pH is a lowering of the pH by more than about 0.03 pH unit; preferably by more than about 0.08 pH unit. One technique for determining the pH of whole smoke is described by Harris et al in *Tobacco Science*, Vol. XXI, p. 58 (1977). Another technique for determining the pH of whole smoke is described by Sensabaugh, Jr. et al in *Tobacco Science*, Vol. XI, p. 25 (1967).

Cigarettes of the present invention generally yield from about 0.2 mg to about 3.5 mg, frequently from about 0.3 mg to about 2.5 mg, more frequently from about 0.4 mg to about 1.5 mg of nicotine when smoked under FTC conditions. Typically, FTC "tar" to FTC nicotine ratios for cigarettes of the present invention are less than about 12, generally less than about 10, frequently less than about 8, and in certain instances less than about 6. Typically, the FTC "tar" to FTC nicotine ratios of a cigarette having an organic acid salt incorporated therein can be lowered by up to about 80 percent of that ratio of similar cigarette not having the salt additive incorporated therein.

The following examples are provided in order to further illustrate the invention but should not be construed as limiting the scope thereof. Unless otherwise noted, all parts and percentages are by weight.

EXAMPLE 1

Cigarettes having lengths of about 84 mm and circumferences of about 24.85 mm have tobacco rod lengths of 57 mm and filter element lengths of 27 mm. The tobacco rod includes a charge of tobacco cut filler weighing about 0.67 g contained in a circumscribing cigarette paper wrap which is sold commercially as 856 Cigarette Paper by Ecusta Corp. The filter element is manufactured using conventional cigarette filter making technology from cellulose acetate tow (2.7 denier per filament, 48,000 total denier) and circumscribing non-air permeable paper plug wrap. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element and about 3 mm of the length of the tobacco rod. Cigarettes so described are manufactured using a Pilot Cigarette Maker from Hauni-Werke Korber & Co. KG.

The filler material employed in providing the tobacco rod is in the form of strands cut at about 32 cuts per inch. The initial filler material includes a blend of about 30 percent Burley tobacco cut filler, about 40 percent flue-cured tobacco cut filler, and about 30 percent of a blend of 65 parts volume expanded flue-cured tobacco cut filler and 35 parts volume expanded Burley tobacco cut filler. The blend has an aqueous casing of glycerin and flavors applied thereto. The blend has a nicotine content of about 2.5 percent, a moisture content of about 12 percent, and a glycerin content of about 1.6 percent.

Sodium levulinate is contacted with the smokable material of the cigarettes. As such, a metal salt of levulinic acid is added as such to at least a portion of the smokable material of the cigarette. In particular, 7.8 micrograms of a solution of 10 parts sodium levulinate in 90 parts water is injected into a cigarette so as to provide a cigarette having about 0.1 percent levulinate moiety therein. Such a cigarette is designated as Sample No. 1. Sample No. 2 is provided by injecting 15.5 micrograms of a solution of 25 parts sodium levulinate in 75 parts water into a cigarette such that the cigarette has about 0.5 percent levulinate moiety therein. Sample No. 3 is provided by injecting 31.1 micrograms of a solution of 25 parts sodium levulinate in 75 parts water into a cigarette such that the cigarette has about 1 percent levulinate moiety therein. Another cigarette is not contacted with sodium levulinate, is employed for comparison purposes, and is designated as Sample No. C—1.

The various cigarettes are smoked under FTC conditions. In particular, the tobacco cut filler material within the paper wrapper is burned to yield smoke. Data concerning (i) FTC "tar," FTC nicotine and FTC carbon monoxide, (ii) puff count, and (iii) data concerning the pH of the tobacco itself and mainstream smoke, for Sample Nos. 1-3 and C—1 are presented in Table I.

TABLE I

| Sample | Puff[1] Count | FTC CO[2] (mg) | FTC[2] Nicotine (mg) | FTC[2] "Tar" (mg) | Smoke[3] pH | Tobacco[4] pH |
|---|---|---|---|---|---|---|
| 1 | 8.2 | 13.1 | 1.29 | 12.7 | 6.73 | 5.33 |
| 2 | 8.6 | 13.7 | 1.36 | 13.3 | 6.67 | 5.30 |
| 3 | 8.6 | 13.8 | 1.37 | 13.4 | 6.55 | 5.28 |
| C-1* | 8.5 | 13.6 | 1.29 | 13.1 | 6.82 | 5.25 |

*Not an example of the invention.
[1]Puff count is the average number of puffs per cigarette provided under FTC smoking conditions.
[2]FTC smoking conditions consist of 2 seconds of puffing (35 ml total volume) separated by 58 seconds of smolder.
[3]Smoke pH is the average smoke pH for the mainstream smoke of 20 cigarettes as determined using techniques described by Harris et al in Tobacco Science, Vol. XXI, p. 58 (1977).
[4]Tobacco pH is determined using techniques described by Bacot in USDA Tech. Bul., 1225 (1960).

The data in Table I indicate that the smoke pH of the cigarettes decreases with increased application of sodium levulinate to the tobacco material, and the FTC "tar" to FTC nicotine ratios of the cigarettes show an overall decrease with increased application of sodium levulinate to the tobacco material.

The various cigarettes are evaluated organoleptically. Cigarettes having increased application of sodium levulinate are judged as yielding mainstream smoke of (i) low harshness and bitterness, and (ii) desirably high smoothness and mildness.

EXAMPLE 2

The cigarettes containing calcium levulinate are by providing cigarettes in the manner described in Example 1, except that calcium levulinate additive is substituted for the sodium levulinate additive.

The various cigarettes are evaluated organoleptically. Cigarettes having increased application of calcium levulinate are judged as yielding mainstream smoke of (i) low harshness and bitterness, and (ii) desirably high smoothness and mildness.

What is claimed is:

1. A cigarette having smokable material contained in a circumscribing outer wrapping material and having a FTC "tar" to FTC nicotine ratio of less than about 12, the cigarette having (i) a nicotine content greater than about 2.25 percent, based on the dry weight of the smokable material, and (ii) at least one inorganic salt of levulinic acid in contact with the smokable material, the salt being an alkali metal salt of levulinic acid and/or an alkali earth metal salt of levulinic acid.

2. The cigarette of claim 1 wherein the nicotine content thereof is greater than about 2.5 percent, based on the dry weight of the smokable material.

3. The cigarette of claim 1 wherein the nicotine content thereof is greater than about 3 percent, based on the dry weight of the smokable material.

4. The cigarette of claims 1, 2 or 3 wherein the inorganic salt of levulinic acid which is in contact with the smokable material is an amount such that the amount of anionic moiety of that salt is greater than about 0.01 percent, based on the dry weight of the smokable material.

5. The cigarette of claim 1, 2 or 3 wherein the inorganic salt of levulinic acid which is in contact with the smokable material is an amount such that the amount of anionic moiety of that salt is greater than about 0.1 percent, based on the dry weight of the smokable material.

6. The cigarette of claim 1, 2 or 3 wherein the inorganic salt of levulinic acid which is in contact with the smokable material is an amount such that the amount of anionic moiety of that salt is greater than about 0.5 percent, based on the dry weight of the smokable material.

7. The cigarette of claim 1, 2 or 3 wherein the inorganic salt of levulinic acid which is in contact with the smokable material is present in an amount greater than about 0.75 percent, based on the dry weight of the smokable material.

8. The cigarette of claim 1, 2 or 3 wherein the inorganic salt of levulinic acid which is in contact with the smokable material is an amount such that the amount of anionic moiety of that salt is greater than about 1 percent, based on the dry weight of the smokable material.

9. The cigarette of claim 1 or 3 wherein the smokable material is tobacco cut filler material.

10. The cigarette of claim 4 wherein the smokable material is tobacco cut filler material.

11. The cigarette of claim 5 wherein the smokable material is tobacco cut filler material.

12. The cigarette of claim 6 wherein the smokable material is tobacco cut filler material.

13. The cigarette of claim 7 wherein the smokable material is tobacco cut filler material.

14. The cigarette of claim 8 wherein the smokable material is tobacco cut filler material.

15. A cigarette having smokable material contained in a circumscribing outer wrapping material, the cigarette having (i) a nicotine content greater than about 2 percent, based on the dry weight of the smokable material, (ii) at least one inorganic salt of levulinic acid in contact with the smokable material, the salt being an alkali metal salt of levulinic acid and/or an alkali earth metal salt of levulinic acid, and (iii) levulinic acid incorporated therein.

16. The cigarette of claim 15 wherein the inorganic salt of levulinic acid which is in contact with the smokable material is an amount such that the amount of anionic moiety of that salt is greater than about 0.01 percent, based on the dry weight of the smokable material.

17. The cigarette of claim 15 wherein the inorganic salt of levulinic acid which is in contact with the smokable material is an amount such that the amount of anionic moiety of that salt is greater than about 0.1 percent, based on the dry weight of the smokable material.

18. The cigarette of claim 15 wherein the inorganic salt of levulinic acid which is in contact with the smokable material is an amount such that the amount of anionic moiety of that salt is greater than about 0.5 percent, based on the dry weight of the smokable material.

19. The cigarette of claim 15 wherein the inorganic salt of levulinic acid which is in contact with the smokable material is present in an amount greater than about 0.75 percent, based on the dry weight of the smokable material.

20. The cigarette of claim 15 wherein the inorganic salt of levulinic acid which is in contact with the smokable material is an amount such that the amount of anionic moiety of that salt is greater than about 1 percent, based on the dry weight of the smokable material.

21. A cigarette having smokable material contained in a circumscribing outer wrapping material, the cigarette having (i) a nicotine content greater than about 2 percent, based on the dry weight of the smokable material, (ii) at least one inorganic salt of levulinic acid in contact with the smokable material, and (iii) nicotine levulinate.

22. The cigarette of claim 21 wherein the inorganic salt of levulinic acid which is in contact with the smokable material is an amount such that the amount of anionic moiety of that salt is greater than about 0.01 percent, based on the dry weight of the smokable material.

23. The cigarette of claim 21 wherein the inorganic salt of levulinic acid which is in contact with the smokable material is an amount such that the amount of anionic moiety of that salt is greater than about 0.1 percent, based on the dry weight of the smokable material.

24. The cigarette of claim 21 wherein the inorganic salt of levulinic acid which is in contact with the smokable material is an amount such that the amount of anionic moiety of that salt is greater than about 0.5 percent, based on the dry weight of the smokable material.

25. The cigarette of claim 21 wherein the inorganic salt of levulinic acid which is in contact with the smokable material is present in an amount greater than about 0.75 percent, based on the dry weight of the smokable material.

26. The cigarette of claim 21 wherein the inorganic salt of levulinic acid which is in contact with the smokable material is an amount such that the amount of anionic moiety of that salt is greater than about 1 percent, based on the dry weight of the smokable material.

27. The cigarette of claim 1, 2 or 3 having a ratio of FTC "tar" to FTC nicotine of less than about 10.

28. The cigarette of claim 4 wherein the inorganic salt of levulinic acid includes sodium levulinate.

29. The cigarette of claim 4 wherein the inorganic salt of levulinic acid includes potassium levulinate.

30. The cigarette of claim 4 wherein the inorganic salt of levulinic acid includes magnesium levulinate.

31. The cigarette of claim 4 wherein the inorganic salt of levulinic acid includes calcium levulinate.

32. The cigarette of claim 15, 16, 17, 18, 19, 20, 21, 22, 23, 24, 25 or 26 wherein the nicotine content thereof is greater than about 2.25 percent, based on the dry weight of the smokable material.

33. The cigarette of claim 15, 16, 17, 18, 19, 20, 21, 22, 23, 24, 25 or 26 wherein the nicotine content thereof is greater than about 2.5 percent, based on the dry weight of the smokable material.

34. The cigarette of claim 15, 16, 17, 18, 19, 20, 21, 22, 23, 24, 25 or 26 wherein the nicotine content thereof is greater than about 3 percent, based on the dry weight of the smokable material.

* * * * *